United States Patent [19]

Hagood

[11] Patent Number: 5,037,091

[45] Date of Patent: Aug. 6, 1991

[54] BLOCK STACK GAME WITH MAGNETIC EXTRACTOR

[76] Inventor: Thomas A. Hagood, 300 Mariposa, Mountain View, Calif. 94041

[21] Appl. No.: 492,064

[22] Filed: Mar. 12, 1990

[51] Int. Cl.[5] ..... A63F 9/00

[52] U.S. Cl. ..... 273/448; 273/456

[58] Field of Search ..... 273/1 GD, 1 GG, 1 GF, 273/280, 160, 157 R; 428/33; 446/132, 85, 86, 92

[56] References Cited

U.S. PATENT DOCUMENTS

| | | | |
|---|---|---|---|
| 1,509,873 | 9/1924 | Oroway | 273/1 GD |
| 2,598,487 | 5/1952 | Anechiarico | 446/132 |
| 3,674,274 | 7/1972 | Schur | 273/280 X |
| 3,788,641 | 1/1974 | Lemelson | 273/1 GD |
| 3,864,872 | 2/1975 | Hoetzel | 273/1 GG |
| 4,215,858 | 8/1980 | Olsen | 273/1 GG |
| 4,307,886 | 12/1981 | Kemper | 428/33 X |
| 4,705,276 | 11/1987 | Kastle et al. | 273/280 X |
| 4,877,407 | 10/1989 | duPont et al. | 273/1 GF |

FOREIGN PATENT DOCUMENTS

| | | | |
|---|---|---|---|
| 0190876 | 8/1986 | European Pat. Off. | 273/1 GG |

*Primary Examiner*—Paul E. Shapiro

*Attorney, Agent, or Firm*—Paul Hentzel

[57] ABSTRACT

Blocks are stacked and extracted by the players one at a time to score points based on the length and location of the block. Each block has metal disks embedded in the surface. An extraction tool with a magnet on the end is used to engage the metal disk and extract the block from the stack without disturbing the remaining blocks.

32 Claims, 3 Drawing Sheets

BLOCK STACK GAME WITH MAGNETIC EXTRACTOR

TECHNICAL FIELD

This invention relates to block stacking games, and more particularly to such games in which a magnetic device is employed for extracting the blocks.

BACKGROUND

Heretofore in extracting type games such as pick-up-sticks, the sticks were dropped from a cylinder container falling outward into a random maze of buried and overlapping sticks. The player attempts to extract the topmost sticks from the heap without disturbing the underlying sticks. The player's turn ends when he nudges or moves an adjacent stick which leads to endless squabbles and sibling fights over whether the nearby stick actually moved.

Further, these prior art games involved little analytical activity and therefore had minimal educational value. The pile of sticks were structurally amorphous without order or discernable geometric relationships. No understanding or organized analysis was possible. Nothing was hidden which required evaluation. The player merely had to have a sharp eye and a steady hand.

SUMMARY

It is therefore an object of this invention to provide an improved educational stacking and extraction game.

It is another object of this invention to provide such a stacking and extraction game without "nudging" disagreements.

It is another object of this invention to provide such a stacking and extraction game which promotes learning and analysis.

It is a further object of this invention to provide such a game which enhances the players awareness of spacial relationship within a geometric system.

It is a further object of this invention to provide such a game which enhances the players awareness of the support of overhead blocks by underlying blocks.

It is a further object of this invention to provide such a game which enhances the players awareness of the column and buttressing support and cantilever and cantilever ballast support.

It is another object of this invention to provide such a stacking and extraction game with an arbitrary or unknown element within the block stack.

It is another object of this invention to provide such a stacking and extraction game which supports a strategy for selection of the extracted block.

Briefly, these and other objects of the present invention are accomplished by providing a plurality of playing blocks which may be stacked to form an initial stack of blocks. Each block has two end faces and four side faces. Metal members are mounted on at least some of the faces of the blocks. A magnet magnetically engages the metal members and attaches to a block from the stack of blocks during the play of the game. The magnet has a handle for permitting the player to hold the magnet, and to guide the magnet into engagement with a block selected for attachment, and to extract the attached block from the stack of blocks.

BRIEF DESCRIPTION OF THE DRAWING

Further objects and advantages of the present block game and the operation of extraction tool will become apparent from the following detailed description and drawing in which.

Figures 1, 2, 3A, 3B:
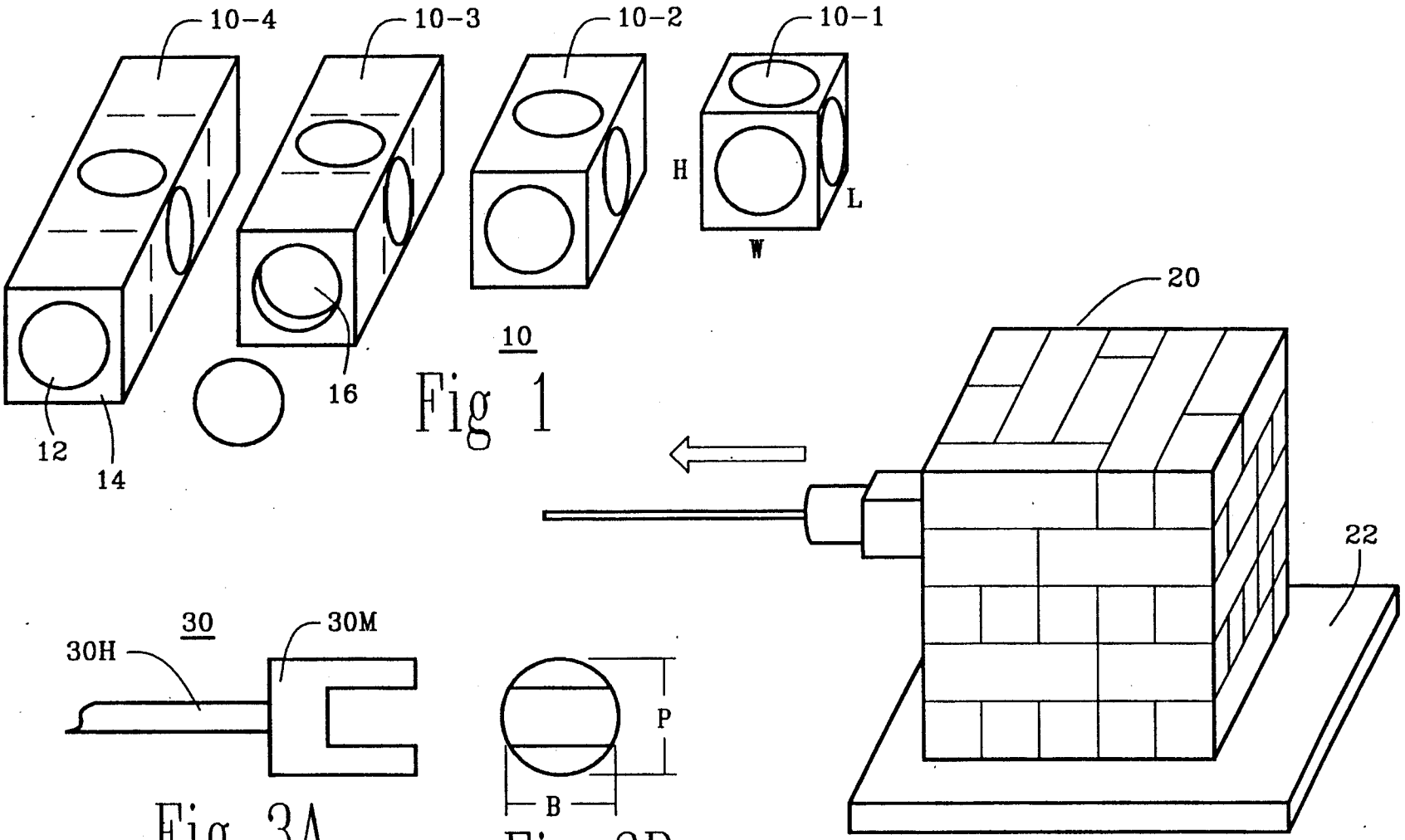
FIG. 1 is a perspective view of the playing blocks showing the increasing lengths.
FIG. 2 is a perspective view showing the initial stack of blocks at the start of the game.
FIG. 3A is a side view of the magnetic extraction tool used to extract the blocks as shown in FIG. 2.
FIG. 3B is an end view of the magnetic extraction tool of FIG. 3A.

The first digit of each reference numeral indicates the Figure in which that element is described. The second digit indicates like structural elements, and the final letter indicates an element subportion.

GENERAL EMBODIMENT

(FIGS. 1, 2 and 3)

The block extraction game is played by stacking blocks 10 of different lengths (FIG. 1) forming a tight cube stack 20 (FIG. 2), or an open labyrinth stack, or just a random stack. The players receive score points by extracting blocks from the stack without disturbing the adjacent blocks using a suitable extraction device such as playing tool 30 (FIG. 3). The tool has magnet 30M at one end and a suitable handle such as stick 30H at the other end. Each block has metal members 12 mounted thereon for attaching to the magnet. In one version of the game, the points received by a player depend on the length and layer position of the extracted block. Long blocks from the lower layers may be assigned a higher score value.

The stack may be supported on a suitable revolving platform such as flat playing table 22 (FIG. 2) mounted on foot 63 (FIG. 5) to assist the players in visualizing the internal structure of stack from all angles before selecting a block. Turning the table also provides convenient access to the side of the stack with the selected block.

As the player turns the playing table and surveys the stacked blocks before his move, he does not know for certain the length of the center blocks. Most of the faces on most of the blocks are covered by adjacent blocks. The only certain information the player has concerns the exposed faces of the surface blocks.

The different block lengths introduces two unknown elements into the player's strategy.

1. The player may know how much support is required by the overhead blocks; and

2. The player may not know how much support is being removed from under overhead blocks.

Long blocks are worth more points because the player is removing more support with a higher risk of overhead collapse.

BLOCK SET (FIG. 1)

The plurality of blocks in the set form subsets of blocks of different lengths. Preferably, all of the blocks have the same height H for permit even stacking of the blocks in layers within the stack. If desired the height H may be the same as the width W producing a square end face 14 as shown in the embodiment of FIG. 1.

The difference in block length may a unit change as shown in the embodiment of FIG. 1. That is, the lengths may be multiples of a fundamental unit length. The first subset is one unit long. The second subset is two units long. The third subset is three units long and so forth to the Nth subset which is N units long. In the FIG. 1 embodiment, four subsets of blocks are shown (N=4). The change in length may be equal to the height H, in which case the smallest block is a unit cube 10-1 with six square faces. The next smallest block 10-2 is two unit cubes long with two square end faces and four identical rectangular side faces.

Suitable metal members such as disks 12 are mounted on selected faces of each block for attaching to magnet tool 30. The metal members maybe embedded in shallow niches 16 with the surface of disk flush with or slightly recessed into the surface of the block to permit the block being extracted to slide past the adjacent blocks. In the embodiment of FIG. 1, a metal member is mounted on both end faces of each block to permit extraction along the longitudinal axis of the blocks. The four side faces may have metal members mounted at mid-length to provide balance if the block is removed edgewise from the side of the stack.

STACK 20

(FIG. 2)

The initial stack formed by the blocks may be a cube one unit longer than the longest block (N+1), in order to conceal at least one end of even the longest blocks in the interior of the stack. A maximum length of four unit cubes (N=4) provides a size cube stack of five units with a workable number of blocks in the set. Adults may prefer a larger set of blocks with N greater than four for longer game times and more complex support and strategy considerations. Children may prefer smaller block sets with shorter play periods, fewer considerations, and faster action. The smaller children sets may be selected from the blocks of a larger set to match the age group, skill requirements and patience limitations of the players.

The long blocks extend across the other blocks and give the stack mechanical stability.

EXTRACTION TOOL 30

(FIG. 3A and 3B)

The magnet on the extraction tool (FIG. 3) has a pair of spaced north and south poles which provides a strong magnetic field for pulling the metal disk and the magnet together into a "clamp-on" relationship. The metal disk becomes the keeper for the magnet poles and is securely held in place. During clamp-on, the disk (and the selected block) and the magnet (and the handle) are locked into a rigid extraction assembly which facilitates removing the block with minimum disturbance of the adjacent blocks.

The rigid extraction assembly is further stabilized by the wide metal to magnet interface provided by the pole-to-pole dimension P and the slightly shorter base dimension B extending across each pole face 30N and 30S. The pole faces are parallel and coplanar for engaging the planar surface of the metal disks.

At clamp-on the stick handle extends perpendicular from the block face in the stack. The audible click accompanying clamp-on may be used as a que that the player has selected a block and cannot change his mind.

CLEAR COLLAPSE RULE

If overhead collapse occurs as the player extracts the selected block, no points are received. Overhead collapse may be defined in two ways, both associated with a very definite visible and audible event in the stack.

1. An overhead block shifts downward in position and contacts a lower layer accompanied by a light thud.
2. An overhead block slips out of the stack and falls onto the playing surface accompanied by a highly visible tumble and crash.

Both of the above collapses produce sound and result in large static changes (objective conditions) which are easy to verify.

The nudging problem is eliminated. The small dynamic change in position of a nudged block is difficult to determine (subjective condition) especially after the nudge has taken place. The cube structure of the blocks permits large quantum changes only.

SKILL RANGE

The stack game may be played over a wide range of hand skills and analytic levels, permitting all ages to play. Small children can begin play immediately after a simple demonstration of stacking the blocks and removing one with the magnet stick. Older children will consider the block points and the scores of the other players. Teenagers might observe cantilever and buttress effects. More advanced players may "count blocks" and calculate the probability of a partially concealed block having a particular length based on the lengths of the previously extracted blocks.

COLOR

The blocks in each layer of the stack may be a different color (or have colored metal disks) to indicate the point value of the block (length times layer number). A six layered stack might be colored:

| | | |
|---|---|---|
| Top Layer | Red | one point per unit length |
| Next Layer | Orange | two points per unit length |
| Third Layer | Yellow | three points per unit length |
| Fourth Layer | Green | four points per unit length |
| Fifth Layer | Blue | five points per unit length |
| Bottom Layer | Purple | six points per unit length |

The points received for a single play could range from one point for a one unit block in the top layer to 30 for a five unit block in the bottom layer.

Each player can calculate his score by examining the color and length of each block in his collection of extracted blocks. A score pad and pencil is not required with colored blocks.

SHEATH EXTRACTION TOOL 40

Figure 5:
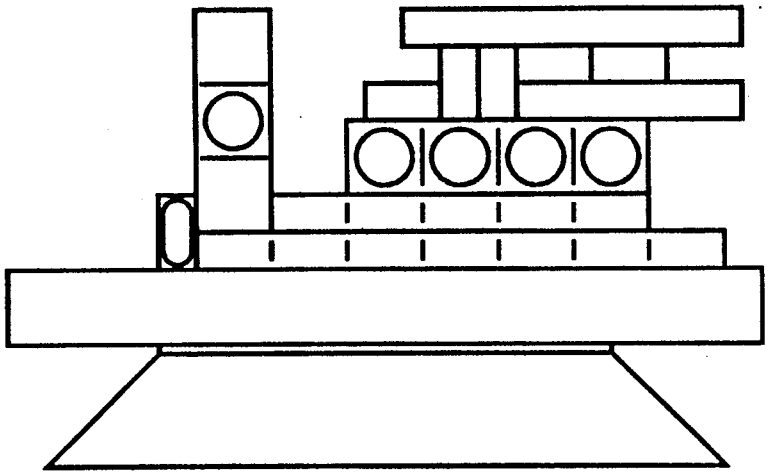
FIG. 5 is a shows a rotating table on a foot with a stack of random length blocks.

(FIG. 5 A B C and D)

Figure 4A:
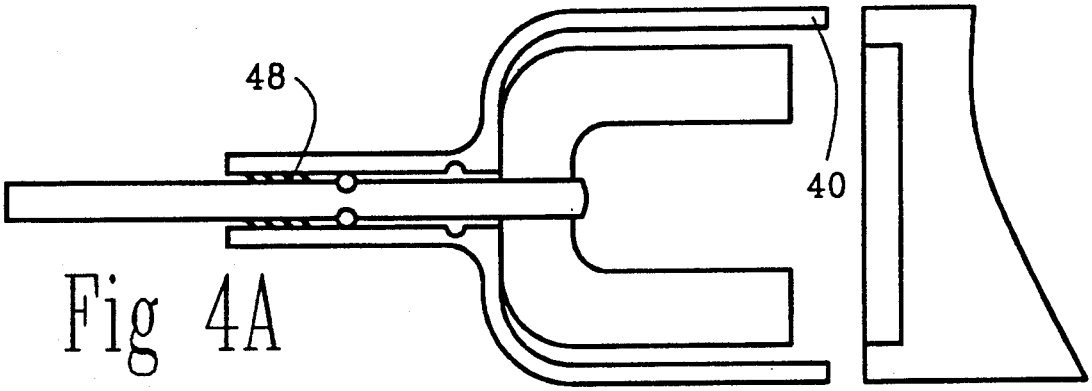
FIG. 4A is a sectional view of an extraction tool with sheath approaching the stack of blocks.
Figure 4B:
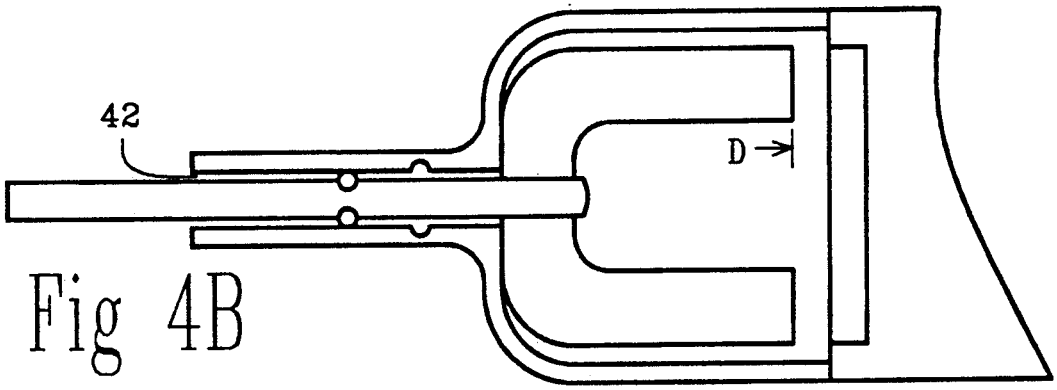
FIG. 4B is a sectional view of an extraction tool with the sheath in the forward position touching the stack of blocks.

The extraction tool may have a suitable shock absorber device such as cylindrical sheath 40 for preventing the initial engagement of the magnet with the selected block from disturbing the remaining blocks. The sheath is slidably mounted on the handle by means of a central bore 42, and has three play positions:

Forward Position (FIG. 4A and 4B) in which the sheath initially contacts the selected block.

Figure 4C:
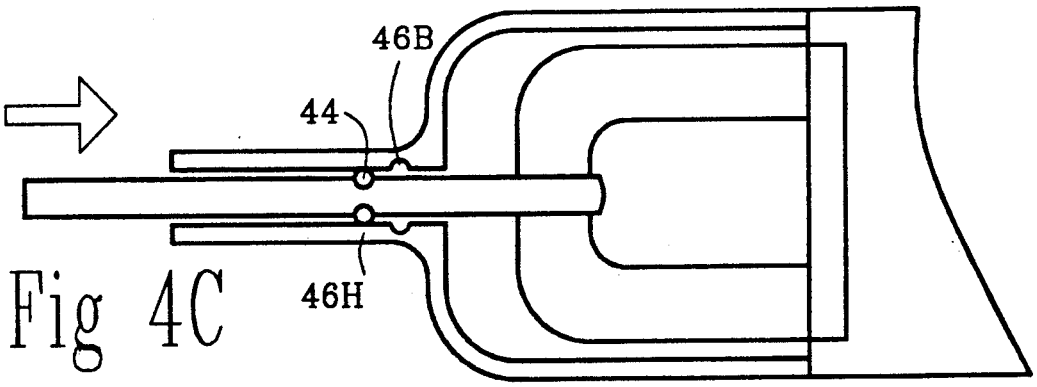
FIG. 4C is a sectional view of an extraction tool with sheath in the middle position and the magnet engaging the metal disk on the blocks.

Middle Position (FIG. 4C) which permits the magnet to engage the selected block.

Figure 4D:
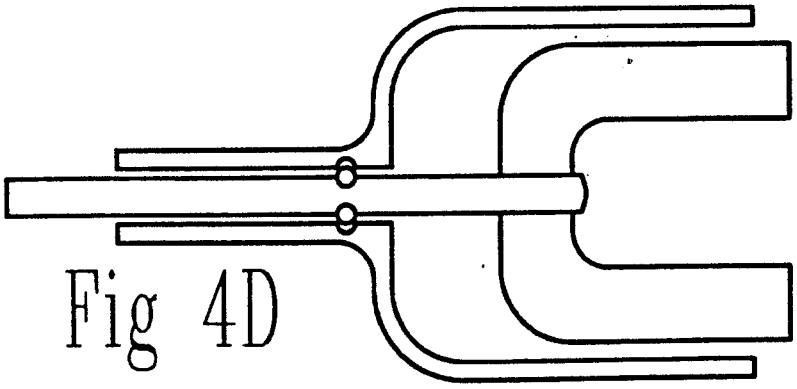
FIG. 4D is a sectional view of an extraction tool with the sheath in the rearward position.

Rearward Position (FIG. 4D) which prevents the sheath from contacting the selected block.

The player may move the sheath along the handle to the desired position.

In the forward position, the sheath extends beyond the magnet face and prevents the magnet from initially engaging the metal members on the selected block with the full attraction force. The effect of the magnet is reduced by distance D defined by the extended portion of the sheath. Without the sheath, the block may snap into engagement with the magnet with sufficient impact to jar the adjacent blocks in the stack.

After the player has guided the sheath into contact with the selected block, the player slowly pulls the sheath back to the middle position. The magnet and the selected block then slowly move together permitting the magnet to softly engage the metal without significant impact.

An experienced player may want to pull the sheath fully back to the rearward position in order to remove the sheath from the play. The sheath is retained in the rearward position by a suitable cooperating retaining structures (FIG. 4D) such as annular collar 44 and annular bore groove 46B. The collar extends radially outward from the handle, and the bore groove extends radially outward into the central bore for receiving and trapping the collar. The relative positions of the collar and the bore groove define the rearward position of the sheath.

The collar may be a resilient ring member having an inside diameter slightly less than the diameter of the handle and an outside diameter slightly larger than the diameter of the central bore. The ring is slipped over the end of the handle and pushed along the handle until seated in annular handle groove 46H.

Preferably the sheath is made of a non-magnetic material and does not interfere with the magnetic field of the magnet. A suitable urging means such spring 48 (FIG. 4A) may be employed to urge the sheath towards the forward position. The spring has one end connected to sheath near the central bore, and the other end connected to the handle near the handle groove for pulling the sheath and the magnet together causing the sheath to extend beyond the face of the magnet.

RANDOM STACK 50

(FIG. 5)

The lengths, widths and heights of the blocks may be deviate from the unit relationship shown in FIG. 1 in order to present a more complex stack to the players. In the embodiment of FIG. 5 the length is random and the height is one half of the width. The blocks may be stacked with the long dimension extending horizontally or vertically for varying the structure of the stack.

WEIGHTED BLOCKS 60

(FIG. 6)

Figure 6:
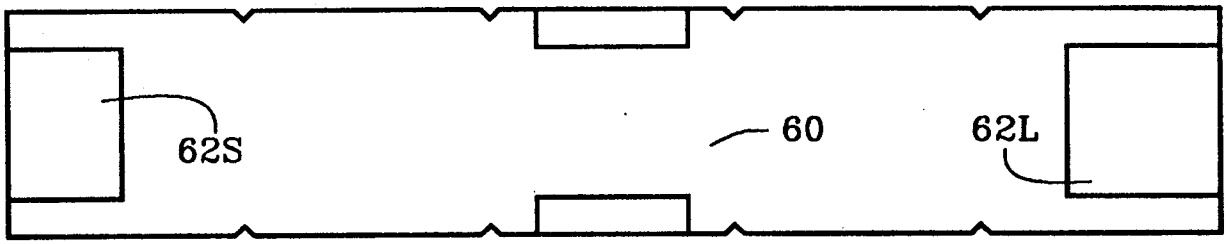
FIG. 6 is a sectional view of a block with off center weights.

Some of the blocks may contain a suitable off center weighting device for introducing additional complexity to the cantilever and buttressing considerations. The embodiment of in FIG. 6, show large cylindrical weight 62L and small cylindrical weight 62S mounted at the ends of long block 60. The exposed surface of the weights serve as the metal disks on the end faces of the block for attaching to the extraction magnet.

The presence and size of each weight may be hidden by the opaque body of the block for adding an element of uncertainty. However, if desired, the size of each weight may be indicated on the exposed end face. Alternatively, the blocks may be formed of a suitable transparent material such as clear plastic for revealing the location and size of each weight.

CONCLUSION

It will be apparent to those skilled in the art that the objects of this invention have been achieved as described hereinbefore.

Clearly various changes may be made in the structure and embodiments shown herein without departing from the concept of the invention. Further, features of the embodiments shown in the various Figures may be employed with the embodiments of the other Figures.

Therefore, the scope of the invention is to be determined by the terminology of the following claims and the legal equivalents thereof.

I claim as my invention:

1. Apparatus for a block stacking and extracting game having any number of players, comprising:

a plurality of playing blocks which may be stacked to form an initial stack of blocks, each block having two end faces and four side faces and forming N subsets of blocks, the first subset having a length of one unit, the second subset having a length of two units, the third subset having a length of three units, and so forth to the Nth subset which has a length of N units, the blocks in each subset having the same length, and the lengths of the subsets are multiples of a the one unit length;

metal means on at least some of the faces of the blocks;

magnet means for magnetically engaging the metal means and attaching to a block from the stack of blocks during the play of the game;

handle means extending from the magnet means for permitting the player to hold the magnet means, and to guide the magnet means into engagement with a block selected for attachment, and to extract the attached block from the stack of blocks.

2. The apparatus of claim 1 wherein N=4.

3. The apparatus of claim 2 wherein the initial stack of blocks may form a cube five unit lengths on a side.

4. The apparatus of claim 1 wherein all of the blocks have the same height.

5. The apparatus of claim 4 wherein the height of the blocks is one half the width.

6. The apparatus of claim 4 wherein the height of the blocks is the same as the width.

7. The apparatus of claim 6 wherein the height and width of the blocks is equal to the unit length.

8. The apparatus of claim 6 wherein the smallest blocks in the plurality of blocks are cubes one unit length on a side.

9. The apparatus of claim 1 wherein the handle means and the magnet means and the metal means on the attached block form a rigid assembly during engagement which assists the player in extracting the attached block from the stack of blocks with minimum disturbance to the remaining blocks.

10. The apparatus of claim 9 wherein the interface between the magnet means and the metal means defines a plane for stabilizing the rigid assembly.

11. The apparatus of claim 10 wherein the interface surface of the metal means is planar for interfacing with the magnet means.

12. The apparatus of claim 11 wherein the interface surface of the magnet means is planar for interfacing with the plane of the metal means.

13. The apparatus of claim 12 wherein the magnet means has a pair of spaced poles having co-planar faces extending parallel to each other and traverse to the direction of the spacing of the poles defining a plane.

14. The apparatus of claim 1 wherein the metal means are metal members embedded in the faces of the blocks.

15. The apparatus of claim 14 wherein each of the metal members has an exterior surface which is exposed and flush with the face of the block.

16. The apparatus of claim 14 wherein the metal members are slightly recessed into the faces of the blocks.

17. The apparatus of claim 14 wherein the metal members are disk shaped.

18. The apparatus of claim 14 wherein the metal members are mounted on the end faces of the blocks.

19. The apparatus of claim 18 wherein the metal members are mounted in the middle of the side faces of the blocks.

20. The apparatus of claim 1 further comprising a shock absorber means mounted proximate the magnet means for preventing the initial engagement of the magnet means with the selected block from disturbing the remaining blocks.

21. The apparatus of claim 20 wherein the shock absorber means is made of a non-magnetic material.

22. The apparatus of claim 20 wherein the shock absorber means has a forward position extending beyond the magnet means for initially contacting the selected block, and a middle position for permitting the magnet means to engage metal means on the selected block.

23. The apparatus of claim 22 further comprising a spring means for urging the shock absorber means towards the forward position.

24. The apparatus of claim 22 wherein the shock absorber means is a cylindrical sheath mounted on the handle means, with a central bore therethrough for slidably engaging the handle means for moving along the handle means between the forward position and the middle position.

25. The apparatus of claim 24 wherein the cylindrical sheath has a rearward position on the handle means for preventing the sheath from initially contacting the selected block.

26. The apparatus of claim 25 wherein the cylindrical sheath further comprises cooperating retaining means on the handle means and in the central bore for retaining the sheath in the rearward position.

27. The apparatus of claim 26 wherein the retaining means on the handle means is an annular collar means extending radially from the handle means, and the retaining means on the central bore is a bore annular groove extending radially away from the central bore for receiving the collar means when the sheath is in the rearward position.

28. The apparatus of claim 27 wherein the collar means is a resilient ring means.

29. The apparatus of claim 28 further comprising a handle annular groove extending radially into the handle means for seating the resilient ring means.

30. The apparatus of claim 1 further comprising weight means mounted off center within at least a portion of the blocks.

31. The apparatus of claim 30 wherein the weight means is located at the end of the block.

32. The apparatus of claim 31 wherein the weight means are metal and are exposed at the end face of the block for engaging the magnet means.

* * * * *